United States Patent [19]

Eldin et al.

[11] 4,255,311

[45] Mar. 10, 1981

[54] STORAGE-STABLE, FORMALDEHYDE-FREE COMPOSITION FOR THE TREATMENT OF TEXTILE MATERIAL CONTAINING HYDROXYL GROUPS

[75] Inventors: Sameer H. Eldin; Hanspeter Gysin, both of Birsfelden, Switzerland

[73] Assignee: Ciba-Geigy Corporation, Ardsley, N.Y.

[21] Appl. No.: 97,591

[22] Filed: Nov. 26, 1979

Related U.S. Application Data

[63] Continuation of Ser. No. 826,781, Aug. 22, 1977, abandoned.

[30] Foreign Application Priority Data

Sep. 3, 1976 [CH] Switzerland ..... 11215/76

[51] Int. Cl.[3] ..... C08L 33/02; C08L 33/08; C08L 63/00

[52] U.S. Cl. ..... 260/29.6 NR; 8/189; 525/111; 525/113; 525/119; 252/8.8

[58] Field of Search ..... 8/189; 252/8.8 B, 8.8 AF; 525/111, 113, 119; 260/29.6 NR

[56] References Cited

U.S. PATENT DOCUMENTS

| | | | |
|---|---|---|---|
| 2,760,886 | 8/1956 | Prentiss et al. | 260/42.52 |
| 2,872,427 | 2/1959 | Schroeder | 260/29.2 EP |
| 2,872,428 | 2/1959 | Schroeder | 260/29.2 EP |
| 2,954,358 | 9/1960 | Hurwitz | 260/29.6 NR |
| 3,028,385 | 4/1962 | Batzer et al. | 260/248 |
| 3,266,971 | 8/1966 | Hartley | 260/29.6 NR |
| 3,305,601 | 2/1967 | Hicks et al. | 260/836 |
| 3,321,432 | 5/1967 | Strasser et al. | 260/29.6 NR |
| 3,331,886 | 7/1967 | Zimmerman et al. | 260/29.6 NR |
| 3,390,114 | 6/1968 | Uhl et al. | 260/29.6 NR |
| 3,449,353 | 6/1969 | Porret et al. | 260/309.5 |
| 3,679,681 | 7/1972 | Habermeier et al. | 260/836 |
| 3,778,439 | 12/1973 | Habermeier et al. | 260/836 |
| 3,809,696 | 5/1974 | Porret et al. | 260/836 |
| 3,843,675 | 10/1974 | Porret et al. | 260/836 |
| 3,846,442 | 11/1974 | Habermeier et al. | 260/836 |
| 3,859,239 | 1/1975 | Van Gils | 260/836 |
| 4,071,477 | 1/1978 | Seltzer et al. | 260/836 |

FOREIGN PATENT DOCUMENTS

| | | | |
|---|---|---|---|
| 601541 | 7/1960 | Canada | 260/29.6 NR |
| 5094297 | 7/1975 | Japan | 8/182 |
| 848350 | 9/1960 | United Kingdom | 260/29.6 NR |
| 1370782 | 10/1974 | United Kingdom | 260/836 |

OTHER PUBLICATIONS

Ruemens, W. et al., Amer. Dyestuff Reporter, Apr. 1973, pp. 43–66.

*Primary Examiner*—Joseph L. Schofer
*Assistant Examiner*—Maria S. Tungol
*Attorney, Agent, or Firm*—Harry Falber

[57] ABSTRACT

A storage-stable, formaldehyde-free composition containing a water-soluble epoxide resin, an acrylic copolymer and an aliphatic polyamine or alkanolamine. This composition is used for the treatment of textile material containing hydroxyl groups and imparts to the fabrics a high resistance to creasing.

11 Claims, No Drawings

STORAGE-STABLE, FORMALDEHYDE-FREE COMPOSITION FOR THE TREATMENT OF TEXTILE MATERIAL CONTAINING HYDROXYL GROUPS

This is a continuation of application Ser. No. 826,781 filed on Aug. 22, 1977, now abandoned.

The invention relates to a storage-stable, formaldehyde-free composition for the treatment of textile material containing hydroxyl groups, particularly fabrics made from natural or regenerated cellulose fibres, but also fibres made from polyvinyl alcohol or mixtures of hydroxyl-containing fibre material with other types of fibres. This composition imparts to the fabrics a high resistance to creasing without impairing their mechanical strength. The fabric treated therewith possesses a good handle and is moreover free from yellowing effects.

A process for creaseproofing cellulose materials is known from the Swiss Patent Specification No. 395,114. In this process, the textile material is impregnated with an aqueous liquor containing an epoxidized triacrylylperhydrotriazine and a catalyst splitting off acid; and the impregnation after drying is hardened by heating. Disadvantages of this process are the resulting inadequate wet crease recovery and the reduction in mechanical strength.

A further process for finishing fabrics of all types, especially those made from cellulose fibres, is described in the Swiss Patent Specification No. 471,811. According to this, the textile material is impregnated with a solution containing an N,N'-diglycidyl-hydantoin or N,N'-diglycidyl-parabanic acid; and the impregnated fabric is heated to temperatures of 100° to 300° C., in the process of which a dye applied previously or simultaneously with the solution is fixed on the textile material. The solution can also contain an acrylic copolymer in disperse form, and can then serve as a coating agent on fabrics. The use of such dispersions for impregnating textile material in order to impart better properties to the material, such as better resistance to creasing, is not mentioned. When it is attempted to use them for this purpose, an adequate wet crease recovery is certainly obtained, but the fabric treated in this way is yellowed to an inadmissible extent.

It has now been found that, surprisingly, a composition according to the present invention can be used to impart to textile material containing hydroxyl groups a creaseproof finish without the aforementioned disadvantages occurring.

The composition according to the invention contains (a) 10 to 50 percent by weight of at least one water-soluble epoxide resin based on hydantoin, (b) 40 to 89.9 percent by weight of at least one acrylic copolymer, and in addition (c) 0.1 to 12 percent by weight of an aliphatic polyamine containing ether groups and having exclusively primary amino groups, or of an alkanolamine of the formula I

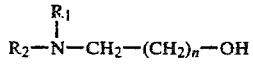

(I)

wherein $R_1$ and $R_2$ independently of one another are hydrogen or the group $—CH_2—(CH_2)_n—OH$, and n is the number 1, 2, 3 or 4, with the percentages being relative to the total weight of (a), (b) and (c).

The composition preferably contains 14–45 percent by weight of (a), particularly up to 28 percent by weight; 50–85, especially 68–85, percent by weight of (b); and of (c) either 0.3–10.5, particularly 3–6, percent by weight of an aliphatic polyamine containing ether groups and having exclusively primary amino groups, or 0.1–6, especially 0.6–2, percent by weight of an alcohol of the formula I.

Examples of epoxide resins which can be used are: N,N'-diglycidyl-5,5-dimethyl-hydantoin and N-glycidyl-N'-glycidyloxypropyl-5,5-dimethyl-hydantoin, and particularly a mixture of these compounds, preferably in the weight ratio of 7:3, wherein a part of the last-mentioned compound, about 5 percent by weight, can be replaced by N-glycidyl-N'-hydroxypropyl-5,5-dimethyl-hydantoin. Applicable also are 5-ethyl-5-methyl-N,N'-diglycidyl-hydantoin, 5-isopropyl-5-methyl-N,N'-diglycidyl-hydantoin, 5-(diethoxyphosphono-2,2-dimethyl-ethyl)-5-methyl-N,N'-diglycidyl-hydantoin and 1,3-bis-(1-glycidyl-5,5-dimethyl-hydantoinyl-3)-2-glycidyloxy-propane. They can be produced in a known manner; see, e.g., the French Patent Specifications Nos. 1,530,771, 1,546,270 and 2,022,997.

The acrylic copolymers used (component b) are preferably those from acrylic acid and methacrylic acid, or particularly those from esters thereof, optionally with the addition of other acids, such as itaconic acid, for example a copolymer from ethyl acrylate, methylmethacrylate and itaconic acid, havine a mean molecular weight of 100,000 to 1,000,000 (such as 600,000) and a carboxyl-group content of 0.1 to 1 val/kg, such as 0.2 val/kg. The production of acrylic copolymers of this kind is described in the U.S. Pat. No. 2,760,886. They are used advantageously in conjunction with softening agents, such as fatty-acid-modified acrylic copolymers, which optionally contain ethylene oxide, react weakly acid to neutral, are usually water-soluble and have a mean molecular weight of the order of about 10,000. The acrylic copolymers are advantageously used in the form of aqueous emulsions, e.g. of an emulsion containing 40–50 percent by weight of acrylic copolymer. The composition according to the invention preferably contains about 68 to 85 percent by weight of acrylic copolymer.

As component (c) there can be used amines of the formula II

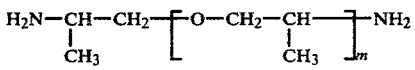

(II)

wherein m has average values of 2 to 20; or compounds of the formula III

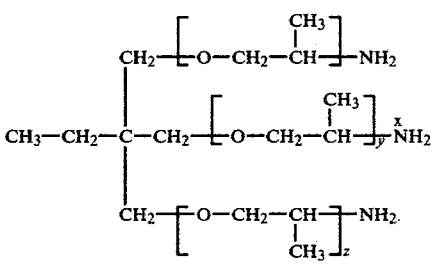

(III)

wherein the sum x+y+z is 5.3; or, as compounds of the formula I, mono-, di- or triethanolamine. Preferably, the composition according to the invention contains 3 to 6 percent by weight of a polyoxypropylenediamine of the formula II or of the triamine of the formula III, or 0.6 to 2 percent by weight of an alkanolamine of the formula I.

For application, the composition, which on mixing of the constituents is normally obtained as an aqueous emulsion, is diluted with water to a concentration of between 1 and 15 percent by weight.

The application comprises impregnating with the treatment composition (2–10%) fabrics made from fibres containing hydroxyl groups, such as natural or regenerated cellulose fibres or fibres made from polyvinyl alcohol, alone or in admixture with other fibre material, in a known manner by application of the 1–15% (by weight) aqueous emulsion to the fabric, or by immersion of the fabric in a bath containing the composition, and squeezing out the impregnated fabric to about 60–80% liquor absorption.

In the following Examples, the fabric specimens, after immersion in the finishing solution, are squeezed out between rollers to the extent that the fabric has a liquor absorption of about 70 percent by weight (±5%). The solutions used are 7.2 percent by weight with respect to the composition according to the invention, and in the comparative examples the solutions used are 7.2 percent by weight with respect to the active substances, with the result that the fabric specimens contain an applied amount when dried of 5 percent by weight (±0.4%). Drying is performed at 120°–140° C. for 5–30 minutes.

The material specimens are tested with respect to the following aspects:

A. YELLOWING

The fabric specimens are assessed visually using a whiteness scale as follows:

1: no yellowing,
2: very slightly yellowed,
3: slightly yellowed,
4: severely yellowed, and
5: very severely yellowed.

The blank specimen (not impregnated but subjected to the same heat treatment as that given to the respective impregnated fabric specimens) has the rating 1.

B. WET CREASE RECOVERY

The fabric specimens are squeezed together by hand under water and then released. The extent to which the fabric opens out again and the rate at which it opens out are assessed visually:

I: clearly better than in the case of the untreated fabric,
II: better than in the case of the untreated fabric,
III: the same as in the case of the untreated fabric.

C. DRY CREASE RECOVERY

The test is made by squeezing together the dry specimen: identical assessment to that under B.

D. HANDLE

I: no change in handle,
II: slight stiffening,
III: stiff handle.

There are two assessments made in each case; except where otherwise indicated, identical results are obtained with both specimens of the fabric.

EXAMPLE 1

Components resin: mixture of about 70 percent by weight of N,N'-diglycidyl-5,5-dimethyl-hydantoin, 25 percent by weight of N-glycidyl-N'-glycidyloxypropyl-5,5-dimethyl-hydantoin and 5 percent by weight of N-glycidyl-N'-hydroxypropyl-5,5-dimethyl-hydantoin;

AMP: acrylic copolymer from ethylacrylate (85 parts), methylmethacrylate (12.5 parts) and itaconic acid (2.5 parts) having a mean molecular weight of 600,000 and a carboxylgroup content of 0.2 val/kg;

WM: fatty-acid-modified acrylic copolymer containing ethylene oxide ("Primal A-9") having a mean molecular weight of about 10,000 and a pH value of 3.7;

amine: polyoxypropylenediamine of the formula II'

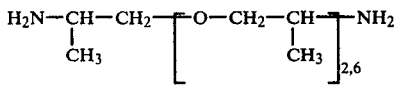

(II').

Preparation of the composition and of the impregnating bath:

67.5 g of a 70 percent by weight solution of the resin in water is mixed with 378 g of a mixture of 103.5 g of AMP and 22.5 g of WM in 252 g of water. There is added 2000 g of water; an addition of 6.75 of amine is subsequently made and the mixture is finally diluted with further water to a total of 2500 g. The mixture is stirred up to give a white homogeneous dispersion. This impregnating liquor (Imp.A) contains 7.2 percent by weight of the stated constituents.

A mercerised cotton fabric specimen having dimensions 18×25 cm is immersed in this bath, squeezed out and then dried in the aforementioned manner. The specimen is assessed as follows:

A. yellowing: rating 2
B. wet crease recovery: rating I
C. dry crease recovery: rating I
D. handle: rating II.

The impregnating liquor A is stable in storage for at least 3 months at room temperature. The cotton fabrics treated therewith have a finish which is fast to boiling. If there is employed an impregnating liquor (Imp.B) which in composition is identical to Imp.A except for the omission of WM, the assessment of the impregnated cotton material remains the same with the exception of the handle, which is given the rating III.

COMPARATIVE TESTS

1. To provide a comparison, there are produced the following impregnating liquors in which are omitted certain components contained in Imp.A and Imp.B:

Impregnating liquor C (Imp.C)

A 7.2 percent by weight aqueous emulsion of resin and AMP in the weight ratio of 100:258.

IMPREGNATING LIQUOR D (IMP.D)

A 7.2 percent by weight aqueous solution of resin and zinc fluoroborate in the weight ratio of 100:5. Zinc fluoroborate as a curing catalyst for the reaction of epoxide resin with cellulose is known. The impregnating liquor (Imp.D) has only a limited storage stability: a precipitate is forming already after 18 hours.

IMPREGNATING LIQUOR E (IMP.E)

A 7.2 percent by weight solution of the resin in water.

The evaluation of the impregnated fabric specimens gives the following results:

| | Imp. C | Imp. D | Imp. E |
|---|---|---|---|
| yellowing | 3 | 2 | 3 |
| wet crease recovery | I | III | II |
| dry crease recovery | I | III | III |
| handle | III | I | I |

2. The tensile strength (determined on the "Amsler" testing machine) is 3–9% lower and the abrasion resistance ("Accelerotor", 3000 revolutions in 3 minutes) 0% lower than in the case of specimens free from impregnating liquor. If the specimens are treated with a known creaseproofing liquor based on glyoxal resin, melamine resin and urea resin, the reduction in value is 25–40% for the tensile strength and 12–22% for the abrasion resistance.

3. If the amine contained in the composition according to the invention is replaced by, for example, one of the following amines, yellowed specimens are obtained after impregnation: ethylenediamine, triethylenetetramine, N,N-dimethyl-1,4-diaminepropane, N,N'-dimethylpropylamine, benzyl-N-dimethylamine, m-phenylenediamine, N,N-diethylethanolamine, N-methylethanolamine, N,N-dimethylethanolamine, N-ethyl-diethanolamine, N-phenyl-ethanolamine, N-phenyldiethanolamine, piperidine, morpholine, pyrrolidine, hexamethylenetetramine and others.

It is surprising that only the compounds falling under the definition of the amines usable according to the invention are capable of preventing yellowing.

EXAMPLES 2–8

Various mixtures are produced as described in Example 1 with the difference that, instead of the amine of the formula II' used therein, one of the following amines is used in the given amount.

| Example | Amine |
|---|---|
| 2 | 13.50 g of the compound of the formula II, wherein m = 5.6 |
| 3 | 6.75 g of the compound of the formula III |
| 4 | 1.35 g of monoethanolamine |
| 5 | 1.35 g of diethanolamine |
| 6 | 1.35 g of triethanolamine |
| 7 | 1.35 g of 3-amino-1-propanol |
| 8 | 1.35 g of 5-amino-1-pentanol |

When the mixtures according to Examples 2–8 are used to treat cotton specimens as described in Example 1, the assessment of the specimens with regard to yellowing, wet crease recovery, dry crease recovery and handle gives results identical to those in Example 1 for the impregnating liquor A (Imp.A).

We claim:

1. Storage-stable, formaldehyde-free composition for the treatment of textile material containing hydroxyl groups, which composition contains (a) 10 to 50 percent by weight of at least one water-soluble diglycidyl or triglycidyl hydantoin compound, (b) 40 to 89.9 percent by weight of at least one acrylic copolymer, and in addition (c) 0.1 to 12 percent by weight of an aliphatic polyamine containing ether groups and having exclusively primary amino groups, or of an alkanolamine of the formula I

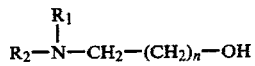

(I)

wherein $R_1$ and $R_2$ independently of one another are hydrogen or the group $—CH_2—(CH_2)_n—OH$, and n is the number 1, 2, 3 or 4, with the percentages being relative to the total weight of the components (a), (b) and (c).

2. Composition according to claim 1, which contains as the component (b) a copolymer from acrylic acid and methacrylic acid or from esters thereof.

3. Composition according to claim 2, wherein the component (b) is a copolymer from ethylacrylate, methylmethacrylate and itaconic acid, having a mean molecular weight of about 600,000 and a carboxyl-group content of 0.2 val./kg.

4. Composition according to claim 1, which contains 14 to 45 percent by weight of (a); 50 to 85 percent by weight of (b); and of (c) 0.3 to 10.5 percent by weight of an aliphatic polyamine containing ether groups and having exclusively primary amino groups, or 0.1 to 6 percent by weight of an alkanolamine of the formula I.

5. Composition according to claim 4, which contains 14 to 28 percent by weight of (a); 68 to 85 percent by weight of (b); and of (c) 3 to 6 percent by weight of an aliphatic polyamine containing ether groups and having exclusively primary amino groups, or 0.6 to 2 percent by weight of an alkanolamine of the formula I.

6. Composition according to claim 1, which contains water.

7. Composition according to claim 1, which contains as component (c) an amine of the formula II

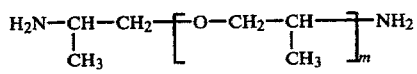

(II)

wherein m has mean values of 2 to 20; or an amine of the formula III

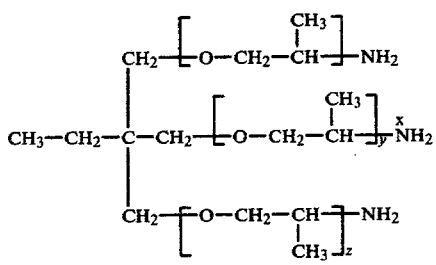

(III)

wherein the sum x+y+z is about 5.3.

8. Composition according to claim 1, which contains as component (c) a mono-, di- or triethanolamine.

9. Composition according to claim 1, which is in the form of an aqueous mixture containing 1 to 15 percent by weight of (a), (b) and (c).

10. Composition according to claim 1, which also contains a softening agent.

11. Composition according to claim 10, which contains as the softening agent a fatty-acid-modified acrylic copolymer.

* * * * *